US007891642B2

(12) United States Patent
Yang et al.

(10) Patent No.: US 7,891,642 B2
(45) Date of Patent: Feb. 22, 2011

(54) EMULSIFIER SYSTEM

(76) Inventors: I-Fu Yang, No. 40, Hwan Gong Road, Yung Kang City, Tainan County (TW) 71041; Yung-Chuan Lin, No. 83, Alley 2, Lane 876, Hou Chang Road, Kaohsiung City (TW) 81142

( * ) Notice: Subject to any disclaimer, the term of this patent is extended or adjusted under 35 U.S.C. 154(b) by 274 days.

(21) Appl. No.: 12/327,228

(22) Filed: Dec. 3, 2008

(65) Prior Publication Data

US 2010/0133706 A1 Jun. 3, 2010

(51) Int. Cl.
*B01F 3/04* (2006.01)

(52) U.S. Cl. ..... 261/28; 261/113; 261/DIG. 75

(58) Field of Classification Search ..... 261/28, 261/29, 34.1, 36.1, 109, 110, 113, DIG. 75
See application file for complete search history.

(56) References Cited

U.S. PATENT DOCUMENTS 1,821,914 A * 9/1931 Wagener ..... 261/77
2,521,215 A * 9/1950 Haddeland et al. ..... 261/36.1
3,900,420 A * 8/1975 Sebba ..... 516/10
3,997,631 A * 12/1976 Matsuoka et al. ..... 261/37
4,859,376 A * 8/1989 Hancock et al. ..... 261/35
5,015,370 A * 5/1991 Fricano ..... 210/138
5,080,802 A * 1/1992 Cairo et al. ..... 210/703
5,314,644 A * 5/1994 Michelsen et al. ..... 261/84
5,403,475 A * 4/1995 Allen ..... 210/774
5,824,243 A * 10/1998 Contreras ..... 261/36.1
5,842,600 A * 12/1998 Singleterry et al. ..... 222/1
5,951,921 A * 9/1999 Koganezawa et al. ..... 261/36.1
6,264,174 B1 * 7/2001 Chang et al. ..... 261/29
6,279,882 B1 * 8/2001 Littman et al. ..... 261/76
6,821,443 B2 * 11/2004 Kim ..... 210/760
2003/0071372 A1 * 4/2003 Scherzinger et al. ..... 261/76

FOREIGN PATENT DOCUMENTS

JP 63-137742 A * 6/1988

* cited by examiner

*Primary Examiner*—Richard L Chiesa
(74) *Attorney, Agent, or Firm*—Pro-Techtor Int'l Services; Ralph Willgohs

(57) ABSTRACT

An emulsifier system includes a mixing pump, a water source, a water intake regulator for regulating the flow rate of water supplied by the water source to the mixing pump, an air intake regulator for regulating the flow rate of air being supplied to the mixing pump for enabling the mixing pump to output a high pressure flow of mixed fluid and gas, and an emulsifier for emulsifying the high pressure flow of mixed fluid and gas outputted by the mixing pump by means of a cavitation effect.

4 Claims, 4 Drawing Sheets

EMULSIFIER SYSTEM

BACKGROUND OF THE INVENTION

1. Field of the Invention

The present invention relates to the application of emulsification technology and more particularly, to an emulsifier system, which emulsifies a high pressure flow of mixed fluid and gas by means of a cavitation effect.

2. Description of the Related Art

Micro air bubbles released from air dissolved water after relief of pressure are intensively and successfully used in water treatment and for other applications. The smaller the size of air bubbles is the longer the retaining time of air bubbles in water and the greater the effect of air bubbles will be. Emulsification occurs when the density of air bubbles in water reaches the peak. For emulsification, the diameter of air bubbles must be reduced to a limited number of micrometers. Therefore, how to obtain air bubbles at a relatively smaller diameter and a relatively higher density is one important subject of pressure flotation.

Taiwan patent number 245667 discloses an "Ultra-fine air bubble generator", which uses a multi-stage pump to pump air into water for producing a mixed flow of air and water, enabling the mixed flow of air and water to be delivered to a pressure relief device to relieve pressure transiently, thereby producing ultra fine air bubbles.

However, due to structural limitation, the size and density of the air bubbles produced by the aforesaid patent cannot reach the emulsification condition.

SUMMARY OF THE INVENTION

The inventor discovered that when a liquid is flowing in a region where the pressure of the liquid falls below its vapor pressure, vapor bubbles will be formed in the liquid. The vapor bubbles will soon collapse and release high energy. This phenomenon is called cavitation in fluid mechanics.

The inventor further discovered that when a liquid is flowing in a cavitation zone, micro air bubbles will be released from the liquid. Further, when cavitation bubbles collapse, contained air will be dissolved into fine bubbles, at the same time the high energy released due to collapse of cavitation bubbles will produce more air bubbles in the liquid, causing an emulsification effect.

Therefore, it is the main object of the present invention to provide an emulsifier system, which utilizes the cavitation effect of fluid mechanics to spread air bubbles in water, causing formation of emulsification.

To achieve this and other objects of the present invention, the emulsifier system comprises a mixing pump, a water source in water communication with the mixing pump for providing a fluid to the mixing pump, a water intake regulator in communication with the mixing pump for regulating the flow rate of the fluid being supplied the water source to the mixing pump, an air intake regulator in communication with the mixing pump for regulating the flow rate of a gas into the mixing pump for dissolving in the fluid being supplied to the mixing pump for enabling the mixing pump to output a high pressure flow of mixed fluid and gas, and an emulsifier connected to the mixing pump to receive the high pressure flow of mixed fluid and gas outputted by the mixing pump. The emulsifier comprises a housing, a partition board mounted in the housing and dividing the housing into a front chamber and a rear chamber, the partition board comprising a plurality of narrow holes disposed in communication between the front chamber and the rear chamber for causing a cavitation effect to emulsify the high pressure flow of mixed fluid and gas when the high pressure flow of mixed fluid and gas is flowing into the emulsifier.

According to the preferred embodiment of the present invention, the narrow holes of the emulsifier have a width smaller than 0.3 mm so that the cavitation zone takes more than 20% of the cross sectional area of the narrow holes.

According to the preferred embodiment of the present invention, the emulsifier further comprises a gap adjustment plate mounted on one side of the partition board and movable relative to the partition board to regulate the passage of the narrow holes, the gap adjustment plate comprising a plurality of narrow holes corresponding to the narrow holes of the partition board.

According to the preferred embodiment of the present invention, the mixing pump is a centrifugal pump comprising a housing, a pump shaft mounted in the housing, at least one impeller vane rotatable with the pump shaft relative to the housing, and at least one fixed vane affixed to the inside of the housing, the at least one impeller vane and the at least one fixed vane each comprising an outer wheel disk and a plurality of passages cut through the outer wheel disk for the passing of the high pressure flow of mixed fluid and gas axially.

Other features and advantages of the present invention will be fully understood from the further technological features disclosed by the preferred embodiments, simply by way of illustration of modes best suited to carry out the invention.

DETAILED DESCRIPTION OF THE PREFERRED EMBODIMENT

Figure 1:
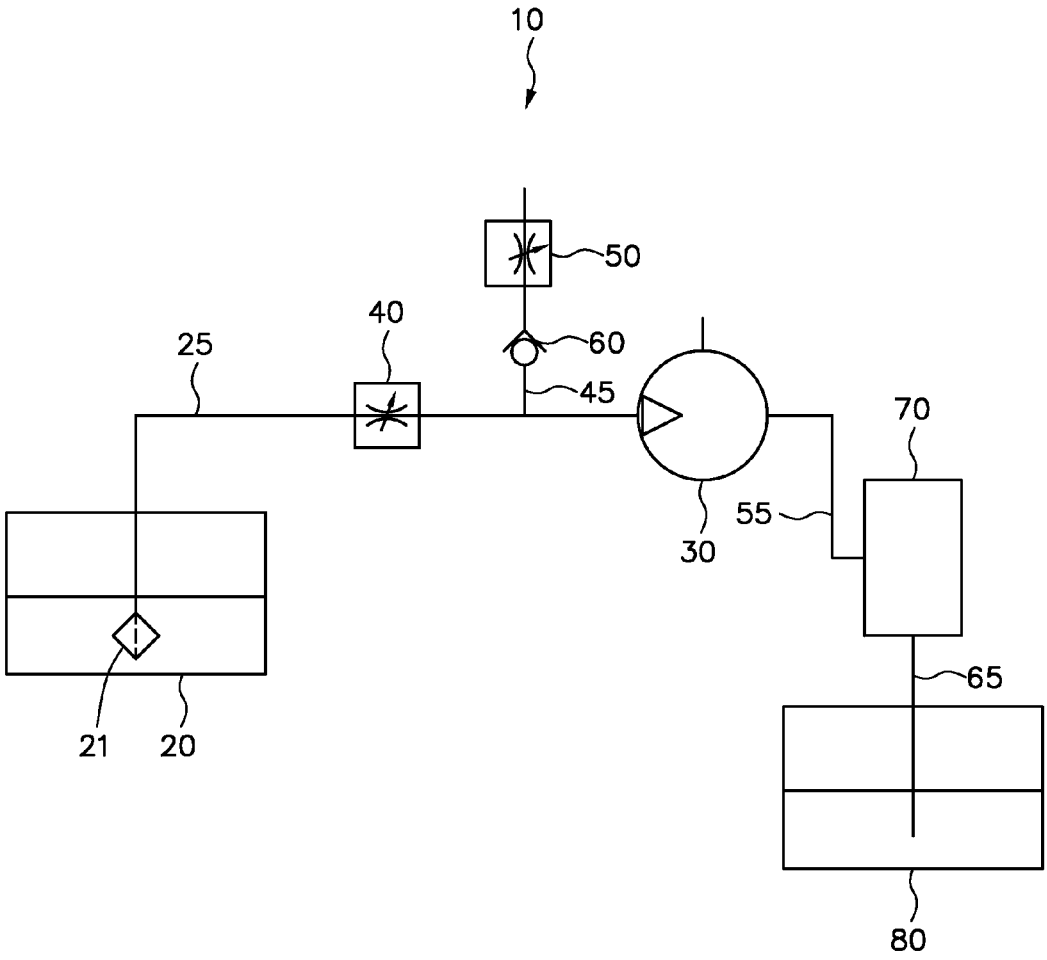
FIG. 1 is a plain view of an emulsifier system in accordance with the present invention.
Figure 2:
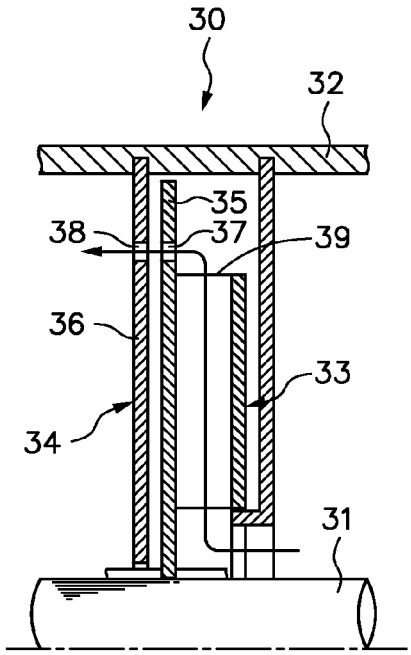
FIG. 2 is a sectional view of a part of the present invention, showing the structure of the mixing pump.
Figure 3:
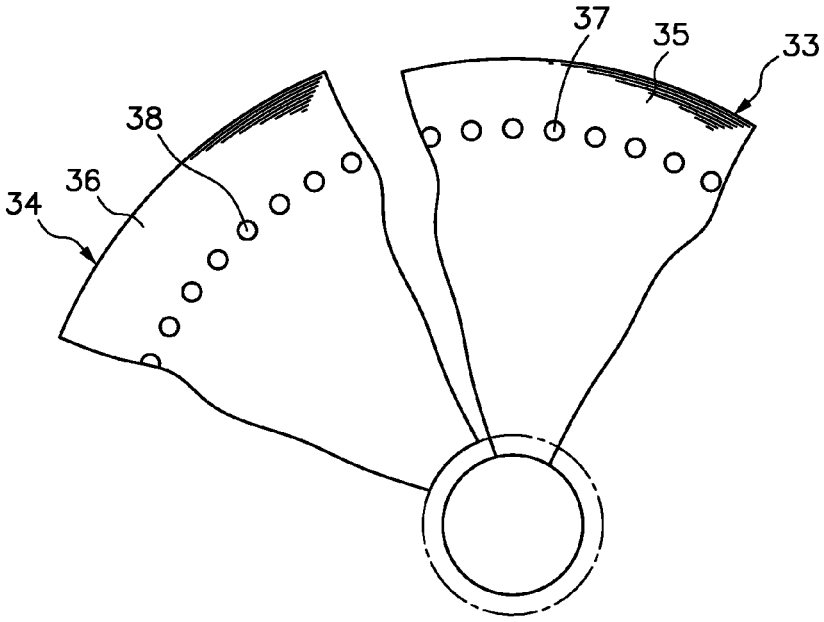
FIG. 3 is a plain view of a part of the mixing pump according to the present invention.

Referring to FIGS. 1~3, an emulsifier system 10 comprises a water source 20, a mixing pump 30, a water intake regulator 40, an air intake regulator 50, a check valve 60, an emulsifier 70 and the necessary piping.

The water source 20 is connected with the mixing pump 30 through a first pipe 25 to supply water to the mixing pump 30. To assure clean water supply, a water filter 21 is installed in the water outlet of the water source 20 to remove solid matters from water being delivered to the mixing pump 30, avoiding blocking of the flow path in the system.

The water intake regulator 40 is installed in the first pipe 25 and adapted for regulating the flow rate of water being delivered from the water source 20 to the mixing pump 30.

The air intake regulator 50 is installed in a second pipe 45 and adapted for regulating the flow rate of air being supplied to the mixing pump 30 for mixing with water. The second pipe 45 is connected to the first pipe 25 between the water intake regulator 40 and the mixing pump 30.

The mixing pump 30 is kept in water communication with the water source 20, and adapted for producing a low pressure at the water intake port to induce flowing of water from the water source 20 into the inside (housing) of the mixing pump 30 and to suck in air for mixing with the intake flow of water, so as to output a saturated mixed flow of air and water of pressure greater than 4.0 kg/cm$^2$. As shown in FIGS. 2 and 3, the mixing pump 30 is a centrifugal type. Unlike conventional centrifugal pumps, comprising a pump shaft 31, an impeller vane 33 rotatable with the pump shaft 31, and a fixed vane 34 affixed to the housing 32 of the centrifugal mixing pump 30. The impeller vane 33 has a plurality of passages 37 cut through the circular outer wheel disk 35 thereof. The fixed vane 34 has also a plurality of passages 38 cut through the circular outer wheel disk 36 thereof for the passing of high pressure mixed fluid of air and water in the axial direction. This will be described further. According to the present preferred embodiment as shown in the annexed drawings, the passages 36 and 38 are circular passages. However, the passages 36 and 38 are not limited to a circular shape. Alternatively, they can be made having an elongated profile. Further, the combination of the impeller vane 33 and the fixed vane 34 can be duplicated to form a multi-step mixing pump for producing a saturated mixed flow of air and water of relatively higher pressure.

The check valve 60 is installed in the second pipe 45 between the first pipe 25 and the air intake regulator 50 to prohibit reverse flow of water from the first pipe 25 into the air intake regulator 50. The check valve 60 and the air intake regulator 50 can be connected in parallel, forming a combination device.

Figure 4:
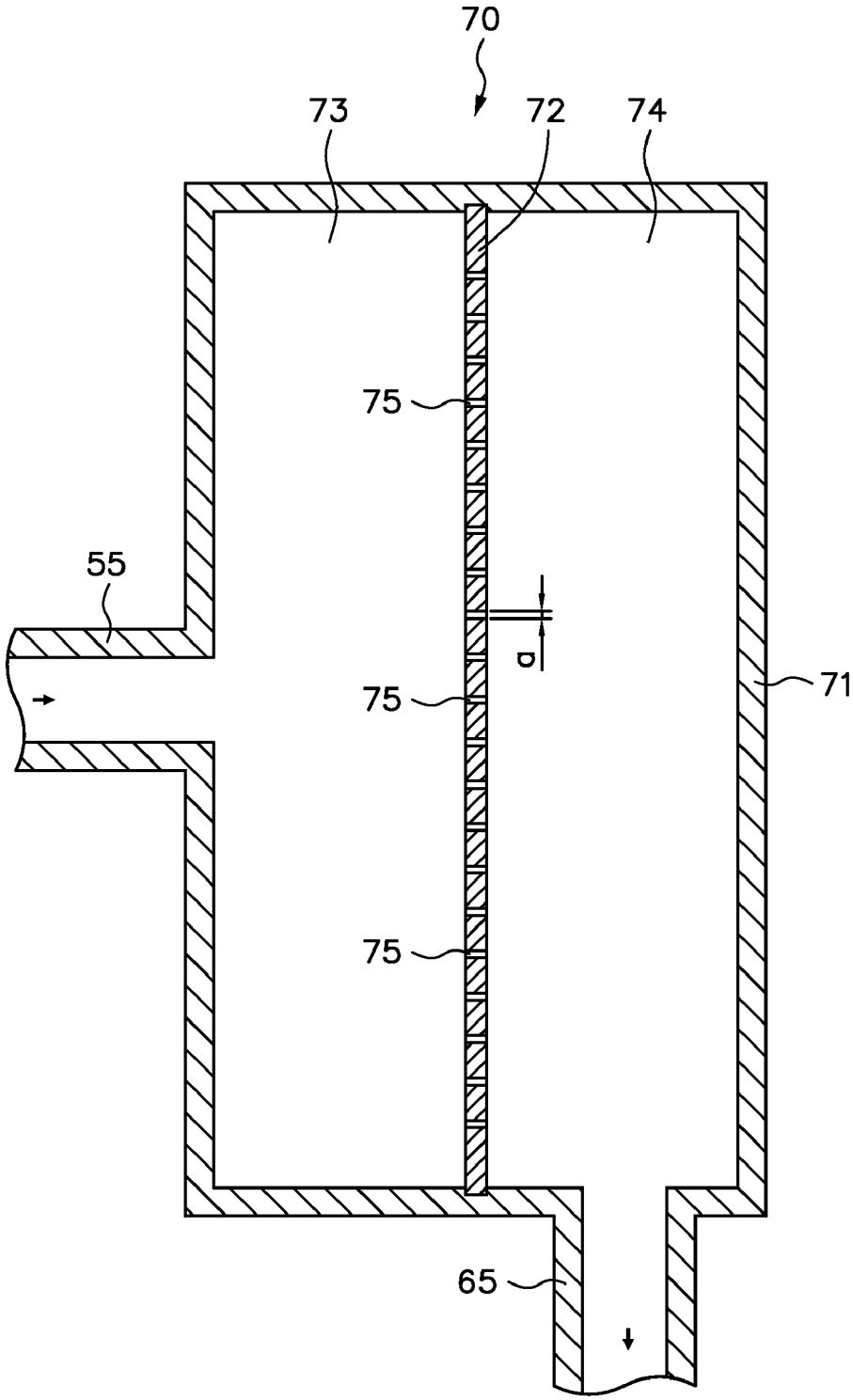
FIG. 4 is a sectional view of the emulsifier of the emulsifier system according to the present invention.

The emulsifier 70 is connected to the mixing pump 30 through a third pipe 55. As shown in FIG. 4, the emulsifier 70 comprises a housing 71, and a partition board 72 mounted in the housing 71 and dividing the inside space of the housing 71 into a front chamber 73 and a rear chamber 74. The partition board 72 has a plurality of narrow holes 75. These narrow holes 75 constitute an emulsification path for causing cavitation upon flowing of a flow of mixed fluid of air and water. Because the cavitation effect is produced only at the edge of each narrow hole 75, the narrow holes 75 have a width a below 0.3 mm for obtaining a relatively higher proportion of cavitation zone so that the cavitation zone can be greater than 20% of the cross section of the narrow holes 75.

During operation of the emulsifier system 10, the mixing pump 30 is started to suck in water from the water source 20 through the first pipe 25 and at the same time, to suck in a proper amount of air from the air intake regulator 50 through the second pipe 45. When water and air are flowing into the housing 32 during rotation of the impeller vane 33, the impeller vane 33 enhances the pressure and speed of the intake flow of water and the intake flow of air, causing the intake flow of air to be dissolved in water, forming a high pressure saturated mixed flow of air and water. When the impeller vane 33 is moving the mixed flow of air and water toward the output port 39, the mixed flow of air and water flows axially through the passages 36 and 38 of the impeller vane 33 and fixed vane 34. At this time, the shear effect produced during rotation of the impeller vane 33 relative to the fixed vane 34 crushes the unevenly distributed air bubbles, causing air bubbles to be evenly distributed in water and shortening the dissolving time of air in water. When the mixed flow of air and water is forced out of the mixing pump 30, the third pipe 55 delivers the mixed flow of air and water to the front chamber 73 of the emulsifier 70. When the mixed flow of air and water is flowing through the narrow holes 75 of the emulsifier 70, it is emulsified subject to a cavitation effect, and the emulsified fluid thus produced flows out of the rear chamber 74 of the emulsifier 70 through a fourth pipe 65 to a water tank 80, or flows back to the water source 20.

Figure 5:
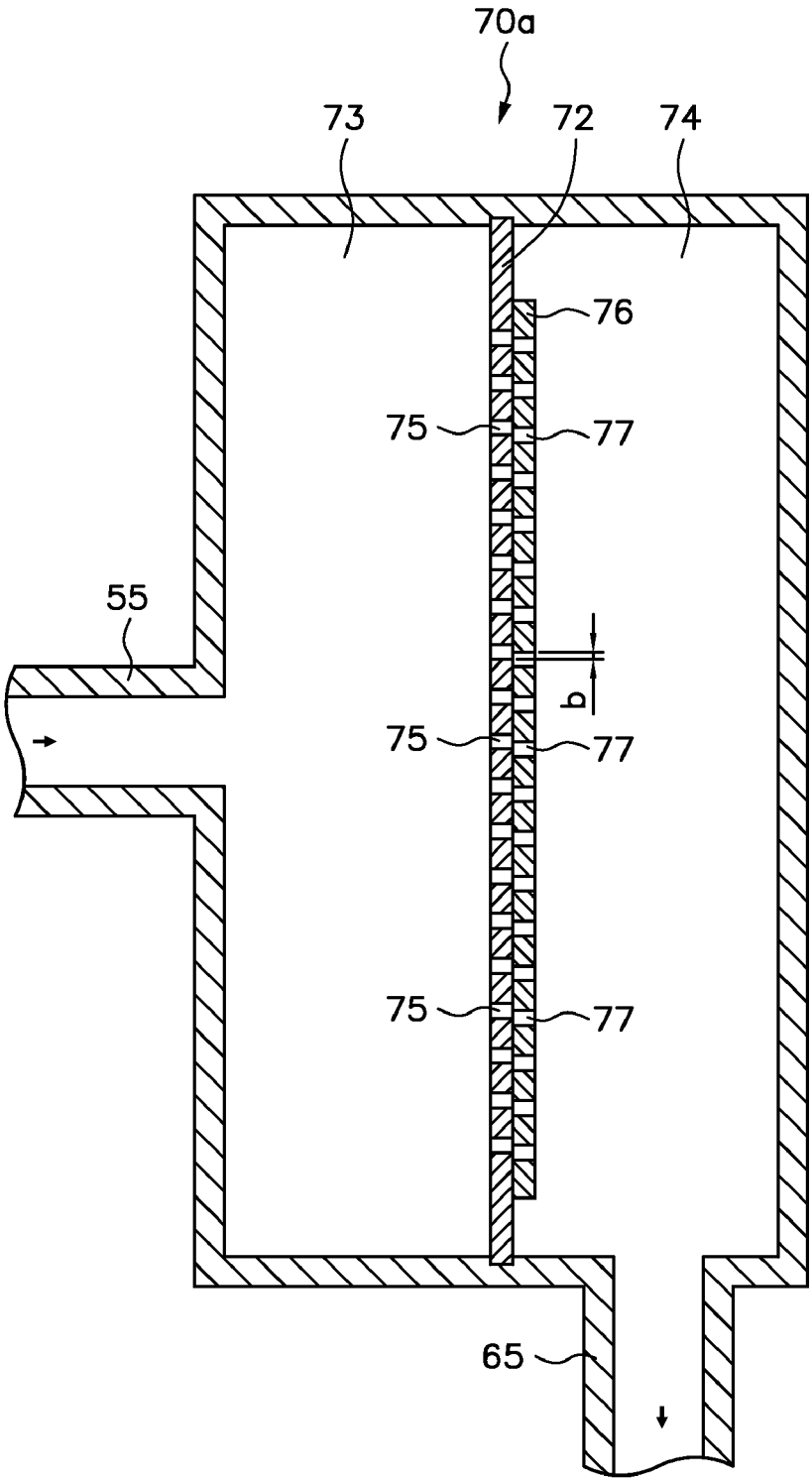
FIG. 5 is a sectional view of an alternate form of the emulsifier of the emulsifier system according to the present invention.

FIG. 5 shows an alternate form of the emulsifier. According to this alternate form, the emulsifier, referenced by 70*a*, is substantially similar to the aforesaid emulsifier 70 shown in FIG. 4 with the exception that this alternate form has an additional gap adjustment plate 76. The gap adjustment plate 76 is movably provided at one side of the partition board 72, having a plurality of narrow holes 77. According to this embodiment, the narrow holes 77 are formed on the additional gap adjustment plate 76 corresponding to the narrow holes 75 on the partition plate 72. Further, the width of the narrow holes 75 and 77 can be several millimeters. When the narrow holes 75 and 77 are axially aligned, the narrow holes 75 are fully opened. By means of moving the gap adjustment plate 76 relative to the partition board 72 to deviate the narrow holes 77 on the gap adjustment plate 76 from the narrow holes 75 on the partition board 72, the opening of the narrow holes 75 on the partition board 72 is adjusted, and therefore the passage gap b in between the front chamber 73 and the rear chamber 74 can be adjusted subject to different flow conditions. When the flow path of the system is blocked, the passage gap b can be adjusted to the maximum to discharge solid impurities.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An emulsifier system, comprising:

a mixing pump;

a water source in water communication with said mixing pump for providing a fluid to said mixing pump;

a water intake regulator in communication with said mixing pump for regulating the flow rate of the fluid being supplied by said water source to said mixing pump; and an air intake regulator in communication with said mixing pump for regulating the flow rate of a gas into said mixing pump for dissolving in the fluid being supplied to said mixing pump for enabling said mixing pump to output a high pressure flow of mixed fluid and gas;

wherein a emulsifier is connected to said mixing pump to receive the high pressure flow of mixed fluid and gas outputted by said mixing pump, said emulsifier comprising a housing, a partition board mounted in said housing and dividing said housing into a front chamber and a rear chamber, said partition board comprising a plurality of narrow holes disposed in communication between said front chamber and said rear chamber for causing a cavitation effect to emulsify said high pressure flow of mixed fluid and gas when said high pressure flow of mixed fluid and gas is flowing into said emulsifier.

2. The emulsifier system as claimed in claim 1, wherein said narrow holes of said partition board have a width smaller than 0.3 mm so that the cavitation zone takes more than 20% of the cross sectional area of said narrow holes.

3. The emulsifier system as claimed in claim 1, wherein said emulsifier further comprises a gap adjustment plate mounted on one side of said partition board and movable relative to said partition board to regulate the passage of said narrow holes, said gap adjustment plate comprising a plurality of narrow holes corresponding to said narrow holes of said partition board.

4. The emulsifier system as claimed in claim 1, wherein said mixing pump is a centrifugal pump comprising a housing, a pump shaft mounted in said housing, at least one impeller vane rotatable with said pump shaft relative to said housing, and at least one fixed vane affixed to the inside of said housing, said at least one impeller vane and said at least one fixed vane each comprising an outer wheel disk and a plurality of passages cut through said outer wheel disk for the passing of said high pressure flow of mixed fluid and gas axially.

* * * * *